US008867954B2

(12) United States Patent
Liu

(10) Patent No.: US 8,867,954 B2
(45) Date of Patent: Oct. 21, 2014

(54) DETACHABLE TONER CARTRIDGE WITH A GATE THAT SLIDES BETWEEN THE OPEN AND CLOSE POSITION OF A TONER OUTLET

(75) Inventor: Quan Liu, Zhuhai (CN)

(73) Assignee: Print-Rite ° Unicorn Image Products Co., Ltd. of Zhuhai (CN)

( * ) Notice: Subject to any disclaimer, the term of this patent is extended or adjusted under 35 U.S.C. 154(b) by 0 days.

(21) Appl. No.: 13/641,193

(22) PCT Filed: Apr. 18, 2011

(86) PCT No.: PCT/CN2011/072944

§ 371 (c)(1),
(2), (4) Date: Oct. 15, 2012

(87) PCT Pub. No.: WO2011/131112

PCT Pub. Date: Oct. 27, 2011

(65) Prior Publication Data

US 2013/0034370 A1 Feb. 7, 2013

(30) Foreign Application Priority Data

Apr. 19, 2010 (CN) ..... 2010 2 0163105 U

(51) Int. Cl.
*G03G 15/08* (2006.01)

(52) U.S. Cl.
CPC .... *G03G 15/0832* (2013.01); *G03G 2215/0692* (2013.01)
USPC ..... 399/106; 399/262; 399/110

(58) Field of Classification Search
CPC ..... G03G 15/0692
USPC ..... 399/106, 120, 262, 263, 107–114, 119
See application file for complete search history.

(56) References Cited

U.S. PATENT DOCUMENTS 5,881,345 A * 3/1999 Yamane et al. ..... 399/255
5,933,691 A 8/1999 Johroku (Continued)

FOREIGN PATENT DOCUMENTS

CN 1182898 A 5/1998
CN 101063861 A 10/2007

(Continued)

OTHER PUBLICATIONS

Kuroyama, Koichi, et al., "Developer Supply Device", Apr. 8, 2000, Japanese Patent Office. Machine Translation.*

(Continued)

*Primary Examiner* — Clayton E Laballe
*Assistant Examiner* — Trevor J Bervik
(74) *Attorney, Agent, or Firm* — Lerner, David, Littenberg, Krumholz & Mentlik, LLP

(57) ABSTRACT

Disclosed is a toner cartridge, which comprises a case, a toner outlet and a gate that can slide to close the toner outlet. The inside of the gate has a bump which can be resisted by the opening mechanism to open the toner outlet. The outside of the gate has an elastic buckle which can be resisted by the closing mechanism to close the toner outlet. The outside of the toner feeding compartment has a notch; the bottom surface of the notch is connected with the outside of the toner feeding compartment through the guiding slope. When the gate is in the closing position, the elastic buckle and the notch coordinate; when the gate is in the opening position the elastic buckle separates from the notch and is put on the outside surface of the toner feeding compartment.

4 Claims, 6 Drawing Sheets

(56) References Cited

U.S. PATENT DOCUMENTS

| | | | | |
|---|---|---|---|---|
| 6,839,534 | B2 * | 1/2005 | Matsuda et al. | 399/262 |
| 7,574,163 | B2 * | 8/2009 | Sato | 399/260 |
| 7,817,943 | B2 * | 10/2010 | Utsumi et al. | 399/254 |
| 8,335,455 | B2 * | 12/2012 | Maeshima | 399/120 |
| 2007/0248384 | A1 | 10/2007 | Kawai | |
| 2007/0269237 | A1 | 11/2007 | Sato | |
| 2009/0245862 | A1 * | 10/2009 | Kawai | 399/119 |

FOREIGN PATENT DOCUMENTS

| | | | |
|---|---|---|---|
| CN | 101075116 | A | 11/2007 |
| CN | 201662687 | U | 12/2010 |

OTHER PUBLICATIONS

Internation Search Report for Application No. PCT/CN2011/072944 dated Jul. 28, 2011.

* cited by examiner

DETACHABLE TONER CARTRIDGE WITH A GATE THAT SLIDES BETWEEN THE OPEN AND CLOSE POSITION OF A TONER OUTLET

CROSS-REFERENCE OF RELATED APPLICATIONS

The present application is a national phase entry under 35 U.S.C. §371 of International Application No. PCT/CN2011/072944 filed Apr. 18, 2011, published in Chinese, which claims priority from Chinese Patent Application No. 201020163105.6 filed Apr. 19, 2010, all of which are incorporated herein by reference.

FIELD OF THE INVENTION

This invention involves a toner cartridge which supplies toner to laser printers, copiers, and other imaging devices. More particularly, this invention involves an improvement on the opening and closing mechanisms of the toner outlet of the toner cartridge.

BACKGROUND OF THE INVENTION

The commonly used laser imaging devices include copiers, printers, and fax machines. For instance, the copiers comprise a photo system which is used as lighting for scanning the original documents, an image forming system which forms toner image on the paper, a paper transfer system which is used to transfer paper from the paper tray through the image forming system and the image fixing system to the paper outlet. All those systems are installed inside the copier. A transparent photo plate is installed on the top of the copier to hold the documents and a cover is placed on the top of the photo plate to press the document onto the photo plate. A photo system is placed underneath of the photo plate.

The imaging forming system is underneath of the photo system and it has a photosensitive drum. A major charger, a developing component, a transfer charger, and a cleaning component are placed, in order, around the photosensitive drum along the swivel direction. The photosensitive drum is driven to rotate in coordination with the scanning of the original document by the photo system and after being evenly charged by the main charger it is exposed to the lightning of the photo system. Thus, an electrostatic latent image is formed on the surface of the photosensitive drum. The electrostatic latent image is developed into the toner image through the developer component. The toner image is transferred to the paper coming from the paper tray. Then, the toner image is developed on the paper by hot fusing of the developer component. The paper with the carbon toner image is transferred to the paper outlet. After the image is transferred the remaining toner left on the photosensitive drum is recycled by the cleaning component.

In the above copiers, the toner supply device, which supplies toner to the developer components, comprises a toner cartridge and a guide way which is used to guide the installation of the toner cartridge, wherein the toner cartridge supplies toner to the image developer component through a funnel which is installed inside the copier. The guide way is located on the top surface of the funnel and is used to guide the inserting or removing of the toner cartridge. When the toner in the funnel is almost depleted may open the front cover of the copier and remove the toner cartridge from the copier and insert a new toner cartridge through the guide way on the funnel and then close the front cover. Thereby the change of the toner cartridge is complete.

In the market today, there is a toner cartridge for the image forming device which comprises a case for containing the toner and a toner outlet on the bottom surface of the case. The toner outlet closes by a sliding gate. When the funnel of the image developer component in the image forming device still has a small amount of toner, the toner cartridge needs to be replaced. When a new toner cartridge is installed on the funnel, the closed gate of the toner outlet needs to slide to open the toner outlet. Thus the toner inside the cartridge drops from the toner outlet to the funnel and into the image developing component.

There are two steps to change the toner cartridge; 1) removing the toner cartridge from the image forming device and then installing a new toner cartridge into it; 2) sliding the gate of the new toner cartridge. This procedure is inconvenient to the users who are unfamiliar with changing the cartridge. Furthermore, in case the user forgot to close the toner outlet after removing the cartridge from the image forming device, the residual toner inside the toner cartridge will fall through the toner outlet and spread everywhere.

DESCRIPTION OF THE INVENTION

Technology Problem

The objective of the invention is to overcome the shortcoming of the current technology, to provide a toner cartridge for the image forming devices to make replacing the toner cartridge easier, and to prevent the users from forgetting to close the outlet.

The Solution to the Problem

To solve the above mentioned technical problem this invention employs the technical scheme as follows: designing a toner cartridge which can be detachably installed in the imaging device. The imaging device has an opening mechanism acting opposite to the cartridge inserting direction and a closing mechanism acting opposite to the cartridge removing direction. The toner cartridge comprises a case for containing the toner, said case has a toner storage compartment and a toner feeding compartment which is equipped with a toner feeding rack; a toner outlet which is used to release the toner and is formed on the bottom surface of the toner feeding compartment; and a gate which slides between the opening position and the closing position of the toner outlet, wherein the inside of the gate has a bump resisted by the opening mechanism to open the toner outlet and the outside of the gate has an elastic buckle resisted by the closing mechanism to close the toner outlet. An outside surface of the toner feeding compartment has a notch; the bottom surface of the notch and the outside surface of the toner feeding compartment are connected by a guiding slope. When the gate is in the closing position, the elastic buckle locks with the notch; when the gate is in the opening position the elastic buckle is released from the notch and put on the outside surface of the toner feeding compartment.

Preferably, the surroundings of the toner outlet form a flange; the flange has a guiding edge extending in the sliding direction of the gate; the outside surface of the toner storage compartment near the gate has a guiding bump which extends in a direction parallel to the extending direction of the guiding edge. The gate is slidable along the guiding edge and guiding bump Preferably, the gate comprises a flat section which contacts with the bottom surface of the flange, and an external clamping section which is located above the outside edge of the flat section, and an internal clamping section which is located below the internal edge of the flat section, said external clamping section clamps on the guiding edge. The internal clamping section clamps on the guiding bump, and the bump is located below the internal clamping section; the elastic buckle is located outside the external clamping section.

Preferably, the elastic buckle comprises an arm section which is parallel to the flat section, a snapping section which is vertical to the flat section, and a grappling hook which can be resisted by the closing mechanism to close the toner outlet. The snapping and the grappling hook both are formed on the end part of the arm section.

Preferably, the toner feeding rack comprises a rotating axis and a first propeller blade and a second propeller blade which are fixed on the rotating axis; the rotating axis can be rotationally supported on the two ends of the toner feeding compartment. The propeller blades rotate in opposite directions and they are respectively located on the two axial sides of the toner outlet. The first propeller blade has a smaller outer diameter than the second propeller blade.

Effectiveness

When installing the toner cartridge of the invention, one can simply use the slide way to insert the toner cartridge inside the imaging device following the predetermined inserting direction. Thereby the gate will automatically move to the opening position. Therefore, a user who is not familiar with replacing toner cartridges can install the toner cartridge without any trouble. When the toner cartridge is to be removed, it can be simply removed by reversing the inserting direction. The gate will automatically move to the closing position, thus the users do not have to use the sliding gate to close the toner outlet and do not have to remember to close it.

EMBODIMENTS OF THE INVENTION

Figure 1:
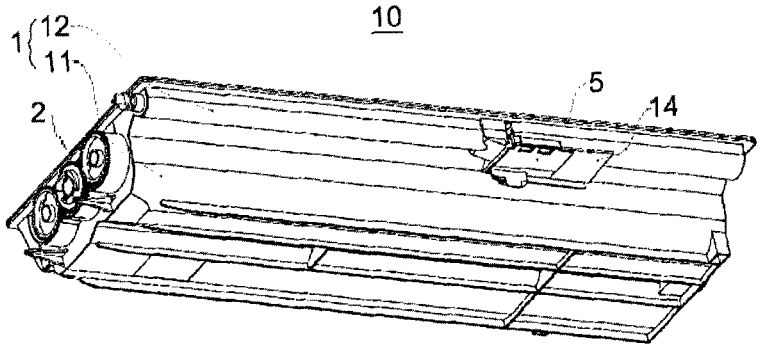
FIG. 1 is a three dimensional diagram of a preferred embodiment of the toner cartridge.
Figure 2:
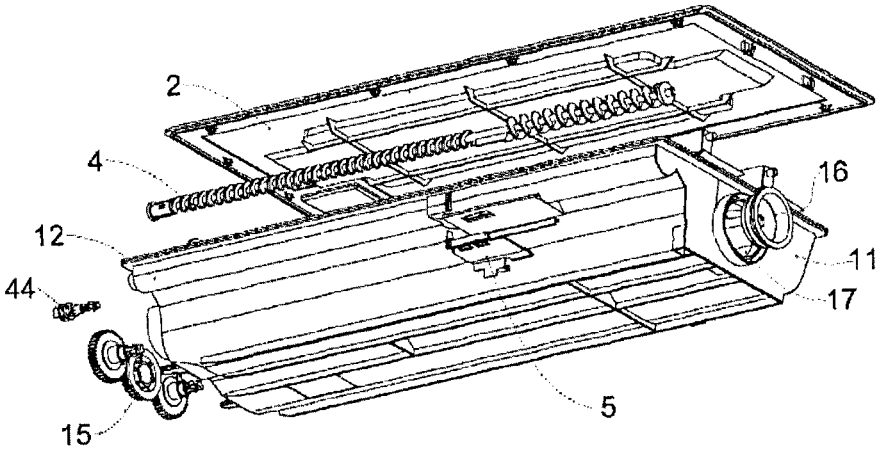
FIG. 2 is an illustrative view of the parts of the toner cartridge of FIG. 1.
Figure 3:
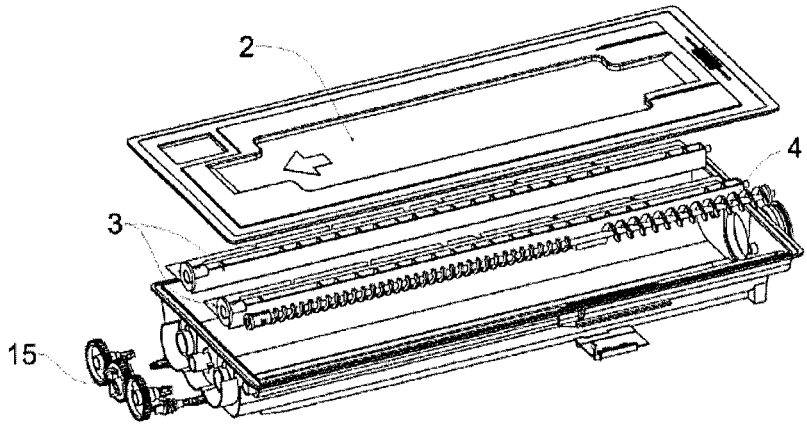
FIG. 3 is an illustrative view of the parts of the toner cartridge of FIG. 1 from a different angle.

FIGS. 1 through 6 show a toner cartridge 10 of the invention. This toner cartridge is detachably installed inside the imaging device. It supplies toner through a funnel to the image development component of the imaging device. The guide way 20 is placed in the opening of the top of the funnel and is used to insert the toner cartridge into or remove it from the guide. This guide way 20 has an opening mechanism and a closing mechanism. The opening mechanism acts in the direction opposite to the toner cartridge inserting direction; the closing mechanism acts in a direction opposite to the toner cartridge removing direction.

The toner cartridge 10 comprises a case 1 which contains the toner and a cover 2 which closes the case 1. The case 1 has a toner storage compartment 11 and a toner feeding compartment 12. On the bottom surface of the toner feeding compartment 12 is equipped with a toner outlet 13 to release the toner. The toner outlet 13 connects the inside and outside of the case 1. The surroundings of the toner outlet 13 form a flange 14. The flange 14 sticks out in the horizontal direction. The inside of the toner storage compartment 11 is equipped with an ink roller 3 which prevents the toner from sticking together and mixing and transferring the toner to the toner feeding compartment 12. The inside of the toner feeding compartment 12 has a toner transfer rack 4 which smoothly transfers the toner from the toner feeding compartment 12 to the toner outlet 13. One end of the cover 2 is equipped with a group of gears 15 which transfer the driving force from the imagining device to the ink roller 3; the other end of the cover 2 is equipped with a sealing cover 16 which is used to seal the toner inlet 17.

On the flange 14 is equipped with a gate 5 which is used to open or close the toner outlet 13. The gate 5 may slide between the opening position to open the toner outlet 13 and the closing position to close the toner outlet 13. When the gate 5 slides to the opening position, the toner in the case 1 falls off from the toner outlet 13. The flange 14 has a guiding edge 141 which may extend in the sliding direction of gate 5. The toner storage compartment 11 has a raised line 6 near the outside surface 111 of the gate 5. The raised line 6 extends in a direction parallel to the extension direction of the guiding edge 141. The gate 5, the guiding edge 141 and the raised line 6 coordinate through sliding. The outside surface 121 of the toner feeding compartment 12 has a notch 122; the bottom surface 123 of the notch 122 is connected with the outside surface 121 of the toner feeding compartment 12 through the guiding slope 124.

Figure 4:
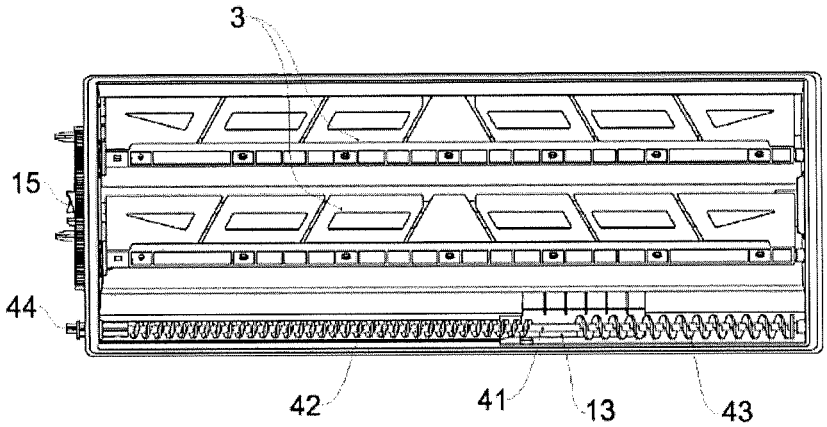
FIG. 4 is a top view of the toner cartilage of FIG. 1 without the cover.
Figure 5:
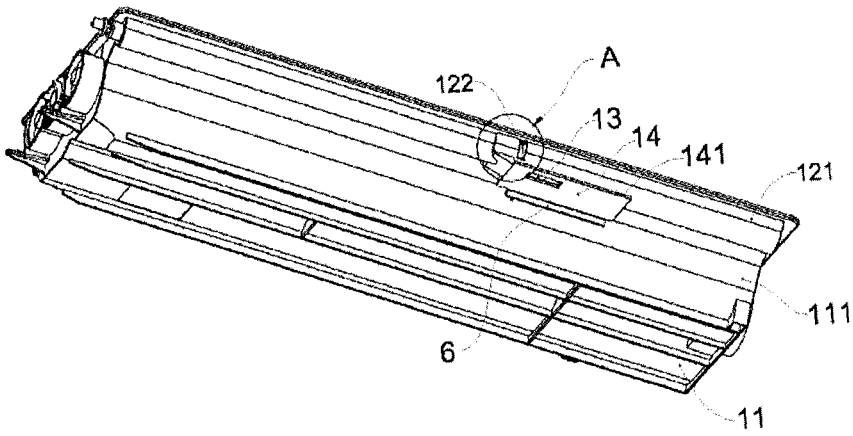
FIG. 5 is a three dimensional view of the toner case of the toner cartridge of FIG. 1.
Figure 6:
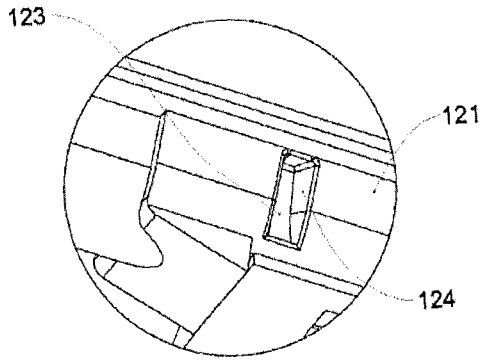
FIG. 6 is an enlarged view from section A.

As shown in FIG. 4, the toner transfer rack 4 is screw-shaped, which comprises a rotating axis 41 and a first propeller blade 42 and a second propeller blade 43; the propeller blades are fixed on the rotating axis 41. The rotating axis 41 is rotationally supported on the two ends of the toner feeding compartment 12. The propeller blades rotate in opposite directions and are respectively located on the two axial sides of the toner outlet 13. The first propeller blade 42 has a smaller outer diameter than the second propeller blade 43; this structure not only avoids the interference with the notch 122 caused by the bump formed inside the toner feeding compartment 12 but also makes the transfer of the toner to the outlet 13 more efficient. The end of the toner rack 4 is equipped with a driving component 44 which forms the driving mechanism to drive the toner transfer rack to rotate through the driving component 44 and push the toner in the case 1 to the toner outlet 13 and ensure all toner in case 1 will fall off through the toner outlet.

The structural uniqueness of the gate 5 and its coordination with the case 1 will be illustrated further as follows.

Figure 7:
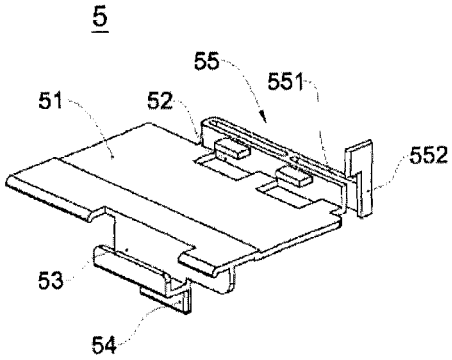
FIG. 7 is a three dimensional view of the gate of the toner cartridge of FIG. 1.
Figure 8:
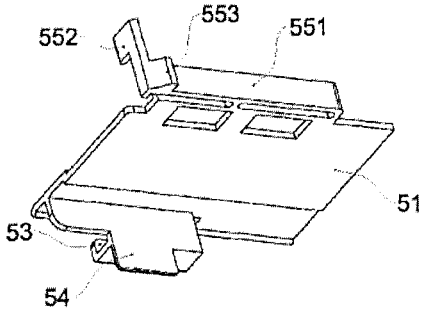
FIG. 8 is a three dimensional view of the gate of the toner cartridge of FIG. 1 from a different angle.
Figure 9:
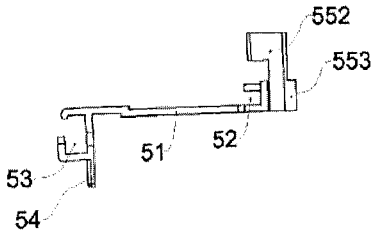
FIG. 9 is a front view of the gate of FIG. 7.

As shown in FIGS. 7 to 9, the gate 5 comprises a flat section 51 which contacts with the bottom surface of the flanges 14, an external clamping section 52 which is located at the outside edge of the flat section 51, and an internal clamping section 53 which is located below the inside edge of the flat section 51. The external clamping section 52 of the gate 5 clamps on the guiding edge 141 of the flanges 14. The internal clamping section 53 clamps on the raised line 6 so that it is installed on the case 1 by sliding. Underneath the internal clamping section 53 is pr bump 54 which can be resisted by the opening mechanism to open the toner outlet 13. The outside of the external clamping section 52 has an elastic buckle 55 which coordinates with a notch 122. The elastic buckle 55 comprises an arm section 551 which is essentially parallel to the flat section 51, a grappling hook 552 which is vertical to the flat section 51, and a snapping section 553 which can be resisted by the closing mechanism to close the toner outlet 13. The grappling hook 552 and the snapping section 553 both are formed at the end of the arm section 551. When the toner cartridge 10 is to be inserted or removed from the guide way 20, the elastic buckle 55 coordinates with the notch 122 to limit the free sliding between the flange 14 and the gate 5; at this time the gate 5 is in the closing position to block the toner outlet 13 and prevent toner from leaking out. When the gate 5 is in the opening position, the grappling hook 552 of the elastic buckle 55 departs from the notch 122 and is put on the outside surface 121 of the toner feeding compartment.

Figure 10:
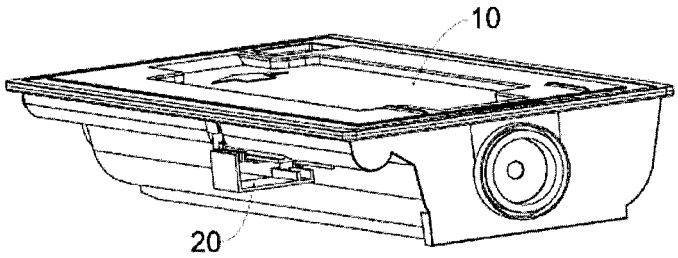
FIG. 10 is an illustrative view of the coordinating structure of the toner cartridge of FIG. 1 with the guiding way inside the imaging device.
Figure 11:
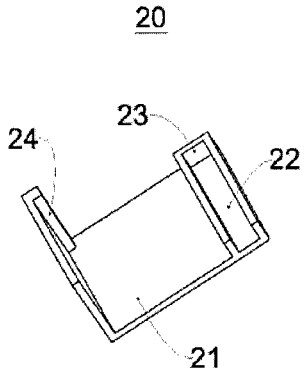
FIG. 11 is a three dimensional view of the guiding way of FIG. 10.

As shown in FIGS. 10 and 11, the guide way 20 comprises a bottom surface 21. The inside of the bottom service 21 has a guide trough 22. At one end of the guide trough 22 is provided with an opening which allows the bump 54 to enter; at the other end of the guide trough 22 there is a fence 23 which blocks the bump 54 from continuing to move forward. The fence 23 functions as the opening mechanism to open the toner outlet 13. The bottom surface 21 has a fence 24 which functions as the closing mechanism to close the toner outlet 13.

Figure 12A:
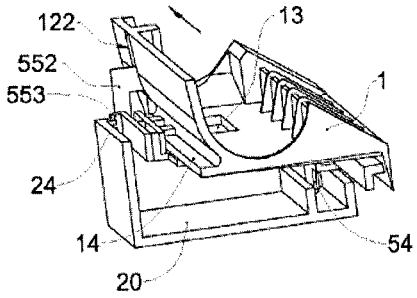
FIGS. 12*a* through 12*d* are illustrative views of gate movement when the toner cartridge is inserted into and removed from the imaging device.
Figure 12B:
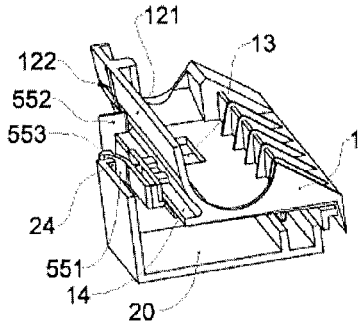

As shown in FIG. 12*a*, when the toner cartridge 10 is just inserted into the imaging device, the gate 5 is in the closing position to block the toner outlet 13; the grappling hook 552 of the gate 5 clips in the notch 122; and at this time the arm section 551 stays vertically. The snapping section 553 may also pass the fence 24. As show in FIG. 12*b*, as the toner cartridge 10 continues to move forward, the gate 5 receives resistance from the fence 23 of the guide way 20 and slides along the flange 14 relative to the case 1. At this time the grappling hook 552 of the gate 5 also slides away from the notch 122 and puts on the outside surface 121 of the toner feeding compartment to push the arm section 551 outwards. In fact, only the flange 14 continues to move forward with the case 1 and the gate 5 does not move relative to the guide way 20. During this process, the toner outlet 13 gradually opens and faces the opening of the funnel, therefore the toner in case 1 can pass the outlet 13 and the funnel to supply the toner to the image developer equipment of the imaging device. Because the gate 5 can automatically open, the toner can be transferred to the funnel from the toner cartridge. Therefore, compared with the two-step process of the current technology (including installing the toner cartridge into the imaging device, then sliding gate 5 to open the toner outlet 13), this embodiment makes the replacement of the toner cartridge easier even to those users who are not familiar with replacing toner cartridges. The toner cartridge will not fail to install by the reason that the gate 5 is not open.

Figure 12C:
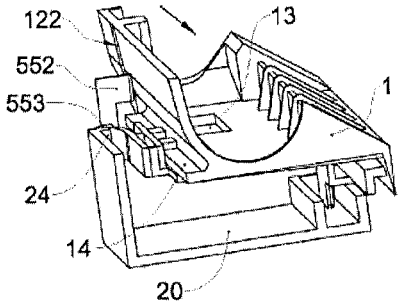
Figure 12D:
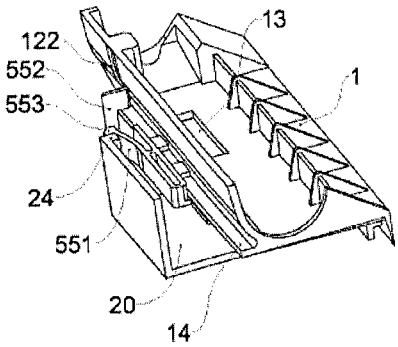

As shown in FIG. 12*c*, when the toner cartridge is to be removed, as the arm section 551 bends outwards, the snapping section 553 receives resistance from the fence 24 and makes the gate 5 unmovable relative to the guide way 20. When the flange 14 moves outwards with the case 1, the gate 5 slides relative to the flange 14. During this process, the toner outlet 13 is gradually closed. As shown in FIG. 12*d*, when it reaches a certain position, the grappling hook 552 of the gate 5 coordinates with the notch 122, and the arm section 551 returns to the vertical state. It makes the snapping section 553 avoid the blockage of the fence 24. Thus, the toner cartridge 10 recovers to the state before it was inserted into the imaging device and it is then successfully removed. This structure does not require manually sliding the gate 5 and purposely closing the toner outlet 13. Therefore the toner will not spread everywhere because the user forgot to close the toner outlet 13.

It needs to be pointed out that the specific structures or components used in the above embodiments are merely used as reference examples for those of ordinary skill in the art to understand the invention. A person of ordinary skill in the art will be encouraged by the technical scheme of the above embodiments to design or imitate technical equivalents which fall within the scope of this invention. Therefore, it is improper to interpret that the claims of this invention are limited by these embodiments. Any equivalents or similar technical schemes will still fall within the scope of the invention.

INDUSTRY APPLICABILITY

When installing the toner cartridge of the invention, one may simply follow the guide way of the imaging equipment and insert the toner cartridge in the predetermined direction, and thereby the gate will automatically move to the opening position. Therefore, even those users who are not familiar with replacing toner cartridges can install the toner cartridge without any trouble. When the toner cartridge is to be removed, the user can simply move the toner cartridge in the opposite direction as it was inserted and then remove it. The gate will automatically move to the closing position; therefore the users do not have to slide the gate to purposefully close the toner outlet and thus the users will not have to remember to close the toner outlet.

What is claimed is:

1. A toner cartridge, which is detachably installed in an imaging device, inside the imaging device having an opening mechanism acting opposite to the cartridge inserting direction and a closing mechanism acting opposite to the cartridge removing direction; said toner cartridge comprising:

a case for containing toner, said case having a toner storage compartment and a toner feeding compartment, wherein the toner feeding compartment is equipped with a toner feeding rack;

a toner outlet located on a bottom surface of the toner feeding compartment;

a gate sliding between an opening position and a closing position of the toner outlet, wherein an inside of said gate has a bump that is resisted by the opening mechanism to open the toner outlet and an outside of said gate has an elastic buckle that is resisted by the closing mechanism to close the toner outlet;

an outside surface of the toner feeding compartment having a notch, wherein a bottom surface of the notch and an outside surface of the toner feeding compartment being connected by a guiding slope;

when the gate is in the closing position, the elastic buckle locks with the notch;

when the gate is in the opening position the elastic buckle is released from the notch and stays on the outside surface of the toner feeding compartment;

wherein a surrounding of the toner outlet forms a flange wherein said flange has a guiding edge extending in a sliding direction of the gate;

wherein an outside surface of the toner storage compartment near the gate has a guiding bump, wherein said guiding bump extends in a direction parallel to the extending direction of the guiding edge;

wherein said gate is slidable along said guiding edge and guiding bump;

wherein said gate further comprises:

a flat section that is in contact with a bottom surface of the flange, wherein the flat section comprises an outside edge and an internal edge that are on opposing sides of the flat section;

an external clamping section which is located above the outside edge of the flat section, wherein said external clamping section clamps on the guiding edge; and an internal clamping section which is located below the internal edge of the flat section, wherein said internal clamping section clamps on the guiding bump;

wherein said bump on the inside of the gate is located below the internal clamping section and said elastic buckle is located outside the external clamping section.

2. The toner cartridge of claim 1, wherein the toner feeding rack comprises:

a rotating axis, wherein said rotating axis is rotationally supported on two ends of the toner feeding compartment;

a first propeller blade and a second propeller blade both of which are fixed on the rotating axis, wherein said first and second propeller blades rotate in opposite directions and are respectively located on the two axial sides of the toner outlet;

wherein the first propeller blade has a smaller outer diameter than the second propeller blade.

3. The toner cartridge of claim 1, wherein said elastic buckle further comprises:

an arm section which is parallel to said flat section, a snapping section which is vertical to the flat section, and a grappling hook which can be resisted by the closing mechanism to close the toner outlet;

wherein said snapping section and the grappling hook are located at the same end part of said arm section.

4. The toner cartridge of claim 3, wherein the toner feeding rack comprises:

a rotating axis, wherein said rotating axis is rotationally supported on the two ends of the toner feeding compartment;

a first propeller blade and a second propeller blade both of which are fixed on the rotating axis, wherein said propeller blades rotate in opposite directions and are respectively located on the two axial sides of the toner outlet;

wherein the first propeller blade has a smaller outer diameter than the second propeller blade.

* * * * *